US012516901B2

(12) United States Patent
Porat

(10) Patent No.: US 12,516,901 B2
(45) Date of Patent: Jan. 6, 2026

(54) ACCESSORIES FOR PISTOL-TO-RIFLE CONVERSION KIT

(71) Applicant: RT Recover Innovations Ltd., Tel Aviv (IL)

(72) Inventor: Tamir Porat, Tel Aviv (IL)

(73) Assignee: RT Recover Innovations Ltd., Tel Aviv (IL)

( * ) Notice: Subject to any disclaimer, the term of this patent is extended or adjusted under 35 U.S.C. 154(b) by 4 days.

(21) Appl. No.: 18/624,378

(22) Filed: Apr. 2, 2024

(65) Prior Publication Data

US 2025/0305783 A1 Oct. 2, 2025

(51) Int. Cl.

| | |
|---|---|
| ***F41A 11/02*** | (2006.01) |
| ***F41A 9/59*** | (2006.01) |
| ***F41A 17/46*** | (2006.01) |
| ***F41A 35/06*** | (2006.01) |

(52) U.S. Cl.

CPC ..... *F41A 11/02* (2013.01); *F41A 9/59* (2013.01); *F41A 17/46* (2013.01); *F41A 35/06* (2013.01)

(58) Field of Classification Search

CPC .. F41A 11/02; F41A 9/59; F41A 17/46; F41A 35/06

See application file for complete search history.

(56) References Cited

U.S. PATENT DOCUMENTS 4,601,123 A * 7/1986 Swearengen ..... F41A 11/02 42/74
4,677,781 A * 7/1987 Lee ..... F41A 17/22 42/72
7,552,557 B1 * 6/2009 Mabry ..... F41A 11/04 42/71.01
9,015,981 B2 * 4/2015 Zamlinsky ..... F41C 23/06 42/75.01
9,109,856 B1 * 8/2015 Zamlinsky ..... F41A 11/02
10,161,709 B1 * 12/2018 Wright ..... F41C 7/00
10,337,813 B2 * 7/2019 Jonsson ..... F41A 3/66
10,345,074 B1 * 7/2019 Zamlinskiy ..... F41C 23/10
10,551,142 B1 * 2/2020 Wright ..... F41A 19/183
11,175,109 B1 * 11/2021 Lee ..... F41A 35/06
11,573,064 B1 * 2/2023 Siepman ..... F41C 3/00
(Continued)

OTHER PUBLICATIONS

European Search Report 25167750, Jul. 31, 2025.

*Primary Examiner* — Michelle Clement
(74) *Attorney, Agent, or Firm* — Dekel Patent Ltd.; David Klein

(57) ABSTRACT

A pistol-to-rifle conversion kit includes a rifle body that includes a lower receiver, which includes a grip mounting portion, which is rearwardly adjacent to a trigger guard, which is rearwardly adjacent to a magazine well receiving portion, an auxiliary trigger sliding mounted in the rifle body and including an elongate member and a forward trigger interface member, which extends from a forward portion of the elongate member and which is configured to interface with a trigger of a pistol mounted in the rifle body, and a trigger member which extends from the elongate member for directly contacting a shooter's finger, and one or more of the following in any combination thereof: an ambidextrous rifle body quick-lock fastener, an ambidextrous magazine release button, an ambidextrous safety selector, and an assault-rifle-style charging handle.

5 Claims, 5 Drawing Sheets

(56) References Cited

U.S. PATENT DOCUMENTS

| | | | | |
|---|---|---|---|---|
| 11,614,296 | B2 * | 3/2023 | Bognar | F41A 19/45<br>42/20 |
| 11,644,260 | B1 * | 5/2023 | Douvier | F41A 11/02<br>42/75.01 |
| 11,692,790 | B2 * | 7/2023 | Porat | F41C 23/12<br>42/69.02 |
| 11,940,240 | B2 * | 3/2024 | Makowski | F41A 21/48 |
| 12,000,671 | B2 * | 6/2024 | Kielsmeier | F41C 33/08 |
| 12,044,492 | B2 * | 7/2024 | Balhan | F41A 35/06 |
| 12,066,271 | B2 * | 8/2024 | Porat | F41G 1/06 |
| 12,085,352 | B2 * | 9/2024 | Douvier | F41A 19/10 |
| 2014/0075803 | A1 * | 3/2014 | Muller | F41A 11/02<br>42/16 |
| 2014/0360076 | A1 * | 12/2014 | Zamlinsky | F41C 23/20<br>42/75.03 |
| 2015/0316339 | A1 * | 11/2015 | Young | F41A 35/06<br>42/49.01 |
| 2022/0307795 | A1 * | 9/2022 | Tasyagan | F41C 23/16 |
| 2024/0077270 | A1 * | 3/2024 | Popp | F41A 19/10 |
| 2024/0247891 | A1 * | 7/2024 | Makowski | F41A 3/88 |
| 2025/0035394 | A1 * | 1/2025 | Hamersley | F41A 11/02 |

* cited by examiner

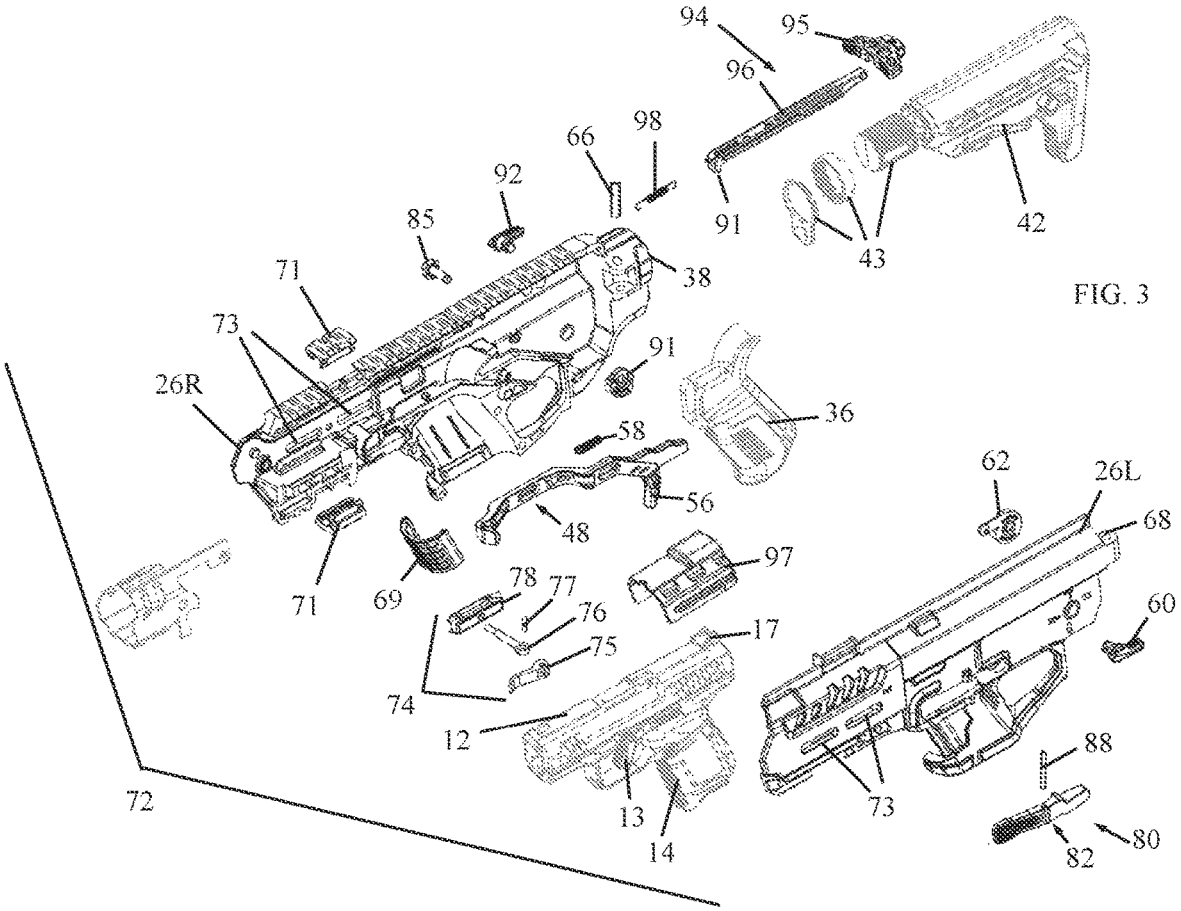
FIG. 3
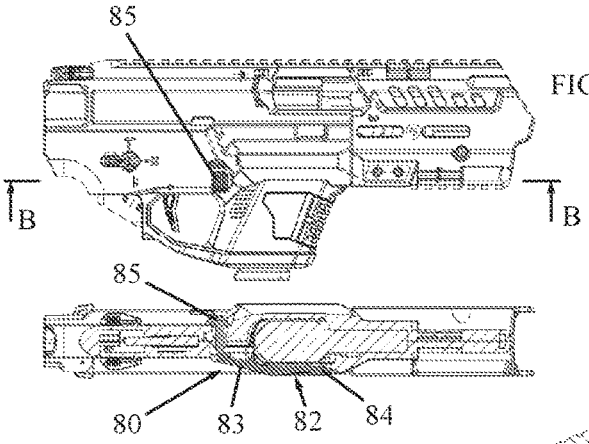
FIG. 4A
FIG. 4B
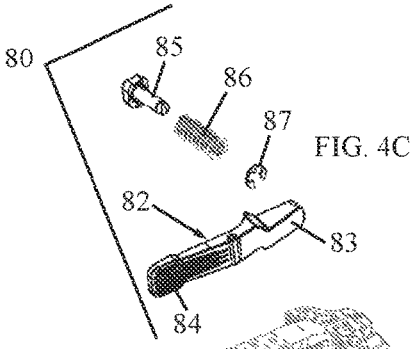
FIG. 4C
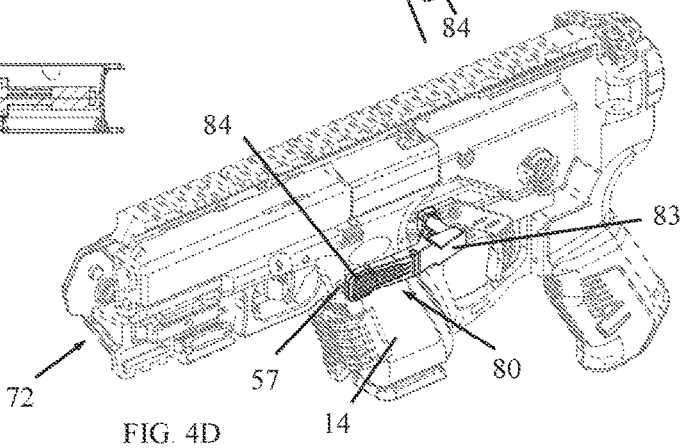
FIG. 4D

ACCESSORIES FOR PISTOL-TO-RIFLE CONVERSION KIT

FIELD OF THE INVENTION

The present invention relates to firearms in general and, in particular, to accessories for a pistol-to-rifle conversion kit that converts a pistol into a rifle with the handle, trigger and magazine positioned as in an assault rifle.

BACKGROUND OF THE INVENTION

U.S. Pat. No. 11,692,790, the disclosure of which is incorporated herein by reference, describes a pistol-to-rifle conversion kit, marketed as the RECOVER TACTICAL P-IX. The pistol-to-rifle conversion kit includes a rifle body that includes a lower receiver, which includes a grip mounting portion, which is rearwardly adjacent to a trigger guard, which is rearwardly adjacent to a magazine well receiving portion. An auxiliary trigger is sliding mounted in the rifle body and includes an elongate member and a forward trigger interface member, which extends from a forward portion of the elongate member and which is configured to interface with a trigger of a pistol mounted in the rifle body, and a trigger member which extends from the elongate member for directly contacting a shooter's finger.

The P-IX conversion kit uniquely has the adjacent, rearward-to-forward order of handle, trigger, and magazine well on the rifle lower receiver, positioned as in an assault rifle, such as the M-16, AR-15 and AK-47. The lower receiver of an assault rifle is the part that houses the grip (handle), trigger guard and magazine well. The P-IX conversion kit uniquely gives the shooter the exact same feel as shooting and changing magazines of an assault rifle, such as the M-16, AR-15 and AK-47.

SUMMARY

The present invention seeks to provide additional novel accessories for a pistol-to-rifle conversion kit that converts a pistol into a rifle with the handle, trigger and magazine positioned as in an assault rifle, as is explained below.

There is thus provided in accordance with a non-limiting embodiment of the invention a pistol-to-rifle conversion kit including a rifle body that includes a lower receiver, which includes a grip mounting portion, which is rearwardly adjacent to a trigger guard, which is rearwardly adjacent to a magazine well receiving portion, the rifle body being straight and non-pivoting from a rear buttstock mounting portion to a forward projectile exiting portion, an auxiliary trigger sliding mounted in the rifle body and including an elongate member and a forward trigger interface member, which extends from a forward portion of the elongate member and which is configured to interface with a trigger of a pistol mounted in the rifle body, and a trigger member which extends from the elongate member for directly contacting a shooter's finger, and one or more of the following in any combination thereof: an ambidextrous rifle body quick-lock fastener, an ambidextrous magazine release button, an ambidextrous safety selector, and an assault-rifle-style charging handle.

BRIEF DESCRIPTION OF DRAWINGS

The present invention will be understood and appreciated more fully from the following detailed description, taken in conjunction with the drawings in which:

FIGS. 1B, 1C, and 1D are simplified perspective illustrations of mounting a pistol into the rifle body of the pistol-to-rifle conversion kit of the prior art, in which FIG. 1B shows opening the fasteners of the rifle body, FIG. 1C shows the rifle body opened and the pistol about to be mounted therein, and FIG. 1D shows the pistol mounted in the rifle body and one of the rifle halves about to be closed.

FIG. 3 is a simplified exploded illustration of the pistol-to-rifle conversion kit, in accordance with a non-limiting embodiment of the present invention.

FIGS. 4A and 4B are simplified right-side and bottom sectional views of an ambidextrous magazine release button of the conversion kit, in accordance with a non-limiting embodiment of the present invention, FIG. 4B being taken along lines B-B in FIG. 4A, and FIG. 4A showing the magazine release button on the right side of the conversion kit, which can be pressed by the thumb of a left-handed shooter to release the magazine from the handgun being held in the conversion kit.

FIG. 4C is a simplified pictorial illustration of the parts of the ambidextrous magazine release button.

FIG. 4D is a simplified pictorial illustration of the ambidextrous magazine release button installed on the conversion kit, showing the magazine release button on the left side of the conversion kit, which can be pressed by the thumb of a right-handed shooter to release the magazine from the handgun being held in the conversion kit.

DETAILED DESCRIPTION

Figure 1A:
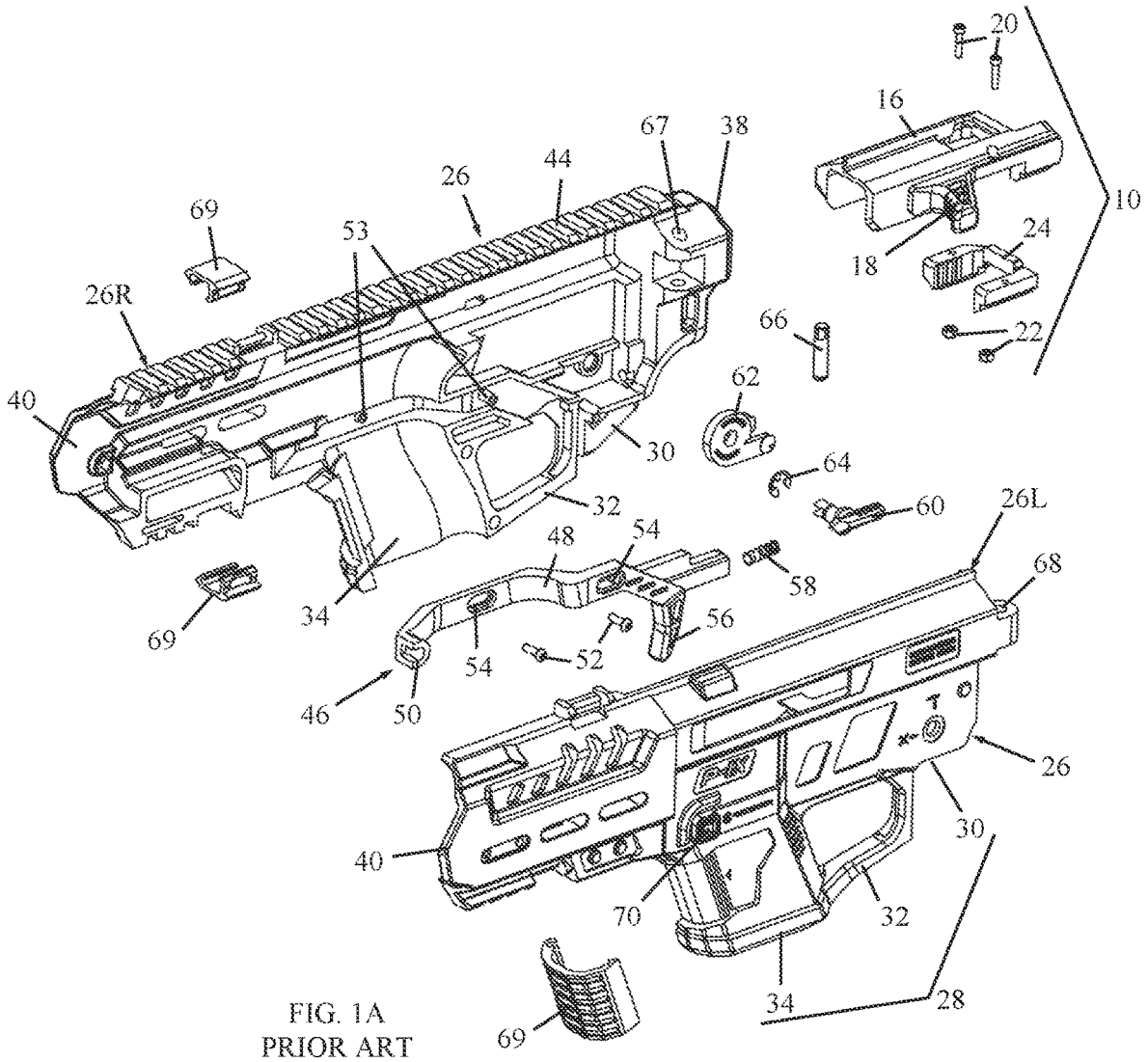
FIG. 1A PRIOR ART
FIG. 1A is a simplified exploded illustration of a prior art pistol-to-rifle conversion kit as described in U.S. Pat. No. 11,692,790.

Reference is now made to FIG. 1A, which is a simplified exploded illustration of a prior art pistol-to-rifle conversion kit as described in U.S. Pat. No. 11,692,790.

The prior art kit includes a charging handle 10, which may include an upper portion 16 with a side gripping handle 18.

Figure 1B:
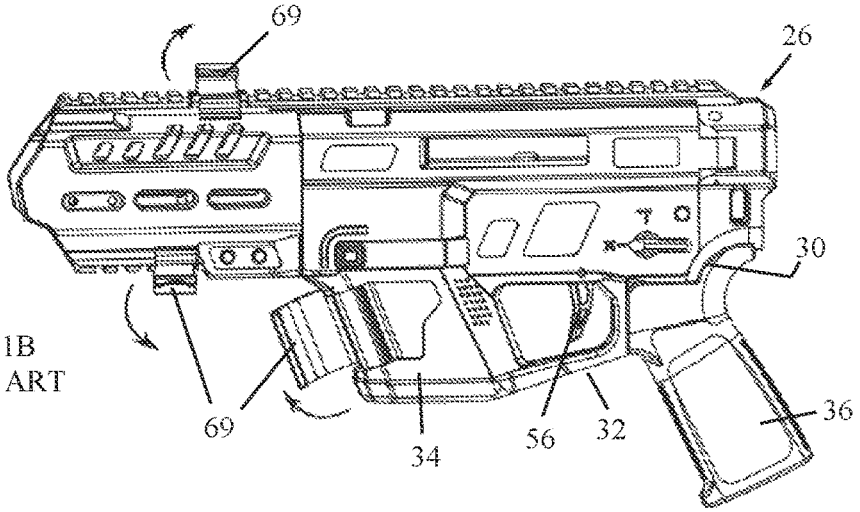
FIG. 1B PRIOR ART
Figure 1C:
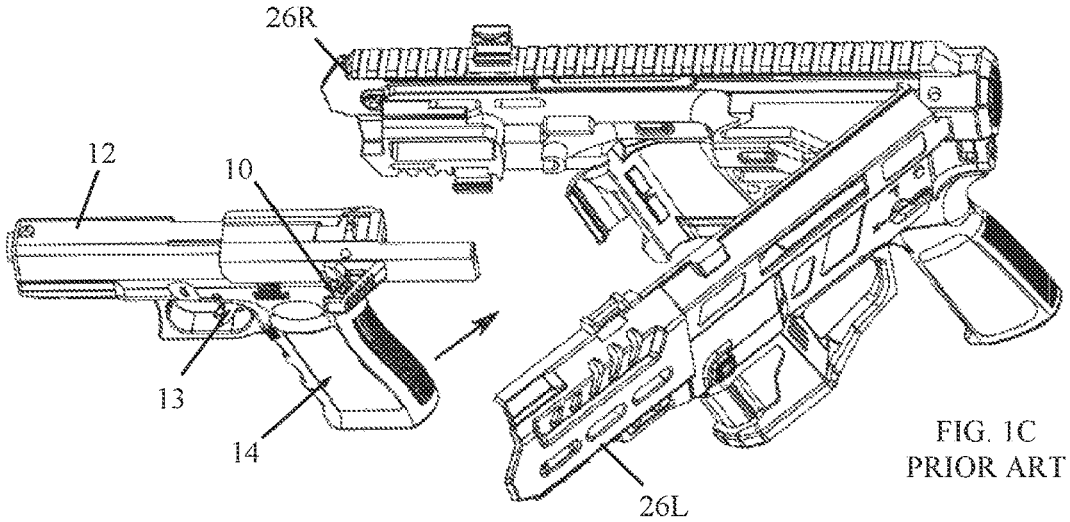
FIG. 1C PRIOR ART

The upper portion 16 may be secured by fasteners 20 and 22 to a lower portion 24, with the upper portion 16 above the slide 12 (slide 12 is shown in FIG. 1C) and lower portion 24 below the slide 12. In this manner, the finished assembly of the charging handle 10 is secured to the slide 12.

Rifle body 26 may include a lower receiver 28, which includes a grip (handle) mounting portion 30, which is rearwardly adjacent to a trigger guard 32, which is rearwardly adjacent to a magazine well receiving portion 34. A grip (handle) 36 (seen in FIG. 1B) may be fastened to the grip (handle) mounting portion 30, with a fastener (not shown).

Rifle body 26 may include at least one accessories rail 44, such as a Picatinny rail, which may extend over most or all of the length of rifle body 26 from rear buttstock mounting portion 38 to forward projectile exiting portion 40.

An auxiliary trigger 46 may be sliding mounted in rifle body 26. The auxiliary trigger 46 may include an elongate member 48 and a forward trigger interface member 50, which extends sideways from a forward portion of elongate member 48. The forward-rearward sliding motion of auxiliary trigger 46 may be guided by one or more pins, screws, or lugs 52 (secured to one or more bosses 53 of rifle body 26) which are received in one or more elongate holes 54 formed in elongate member 48. A trigger member 56 extends from elongate member 48, which the shooter's finger directly contacts. Thus, when the shooter pulls trigger member 56, the forward trigger interface member 50 pulls the trigger 13 of the pistol 14 (seen in FIG. 1D) to fire the pistol. The auxiliary trigger 46 may be spring-loaded by a biasing device 58.

A trigger safety 60 may be provided, which may be coupled to a cam 62, such as by a circlips 64. The trigger safety 60 resembles the safety of an assault rifle and rotation of the trigger safety 60 either prevents or permits pulling the trigger member 56.

The two halves 26R and 26L of rifle body 26 may be pivoted together about a pivot pin 66 which is received in apertures 67 and 68 in halves 26R and 26L, respectively. The halves 26R and 26L may include one or more fasteners or clasps 69 that secure the two halves to each other. In the non-limiting embodiment, there are just three clasps 69 for quick assembly.

The rifle body 26 may include a magazine release catch 70, which is aligned with the magazine catch release of the pistol, when the pistol is installed in the rifle body, so that pressing magazine release catch 70 releases a magazine from the pistol.

Figure 1D:
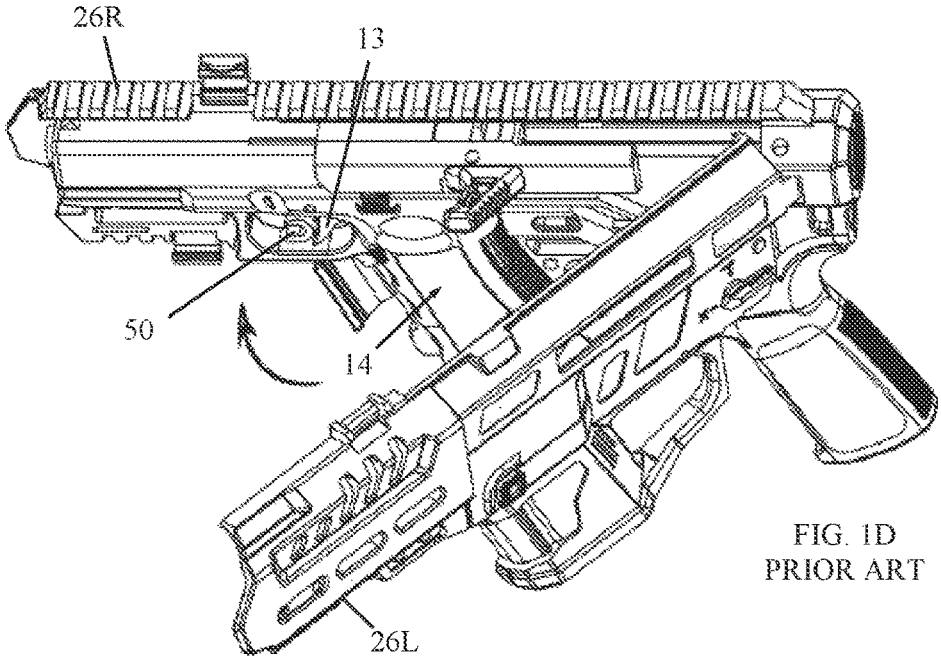
FIG. 1D PRIOR ART

Reference is now made to FIGS. 1B, 1C, and 1D. FIG. 1B shows opening the fasteners 69 of the rifle body 26. FIG. 1C shows the rifle body 26 opened (left half 26L pivoted away from right half 26R) and the pistol 14 about to be mounted therein. FIG. 1D shows the pistol 14 mounted in the rifle body 26 and the left rifle half 26L about to be closed.

Novel Features of Present Invention

Figure 2A:
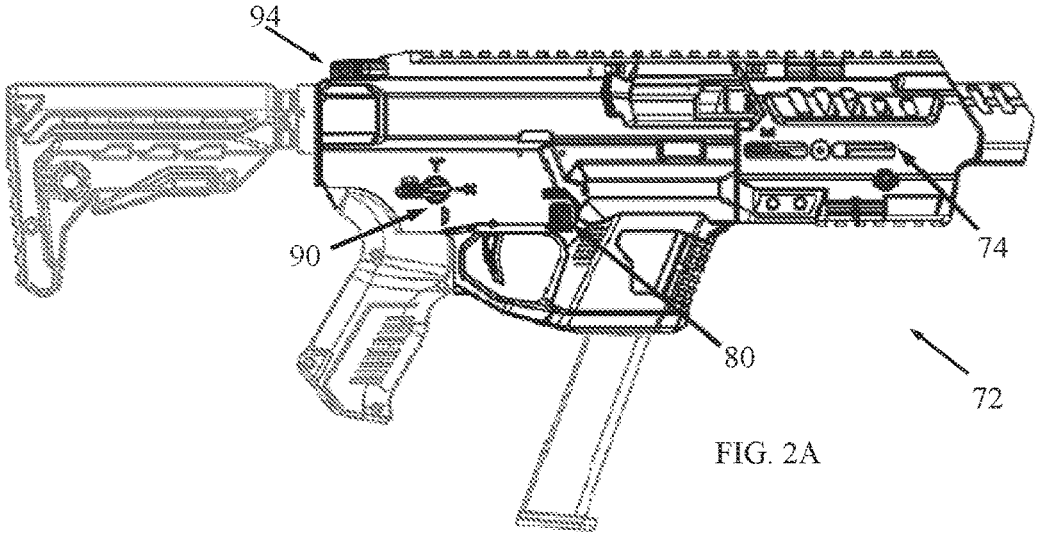
FIGS. 2A, 2B, and 2C are simplified right-side, left-side, and top-view illustrations, respectively, of a pistol-to-rifle conversion kit, in accordance with a non-limiting embodiment of the present invention.
Figure 2B:
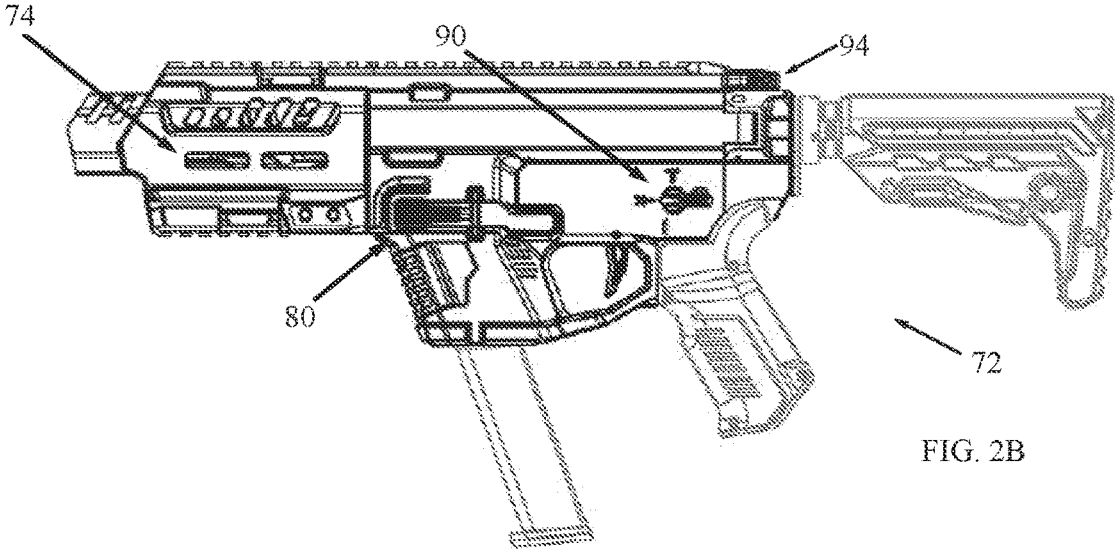
Figure 2C:
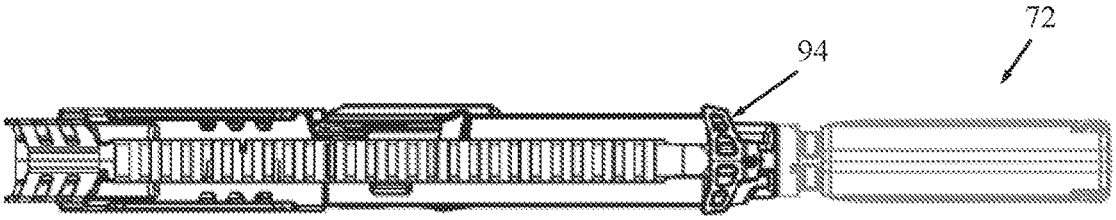
Figure 5A:
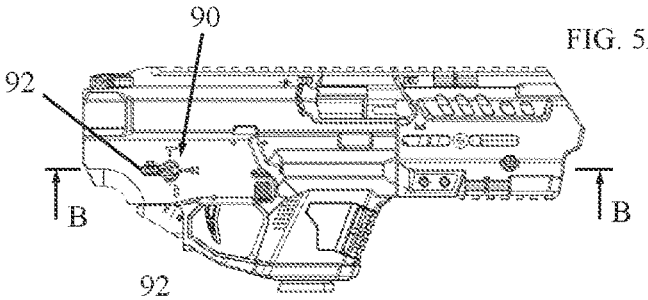
FIGS. 5A and 5B are simplified right-side and bottom sectional views of an ambidextrous safety selector of the conversion kit, in accordance with a non-limiting embodiment of the present invention, FIG. 5B being taken along lines B-B in FIG. 5A, and FIG. 5A showing the safety selector on the right side of the conversion kit, which can be rotated by the thumb of a left-handed shooter to either prevent or permit pulling the trigger member of the conversion kit that pulls the trigger of the handgun being held in the conversion kit.
Figure 5B:
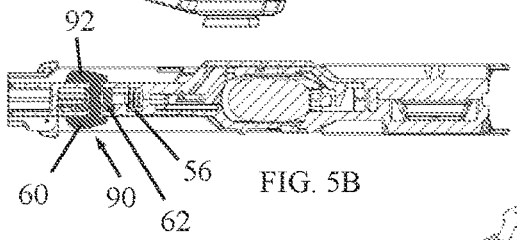
Figure 5C:
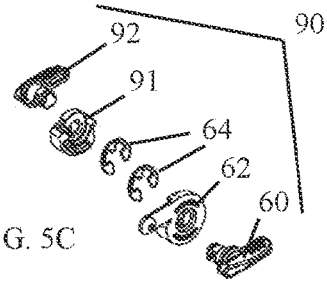
FIG. 5C is a simplified pictorial illustration of the parts of the ambidextrous safety selector.
Figure 5D:
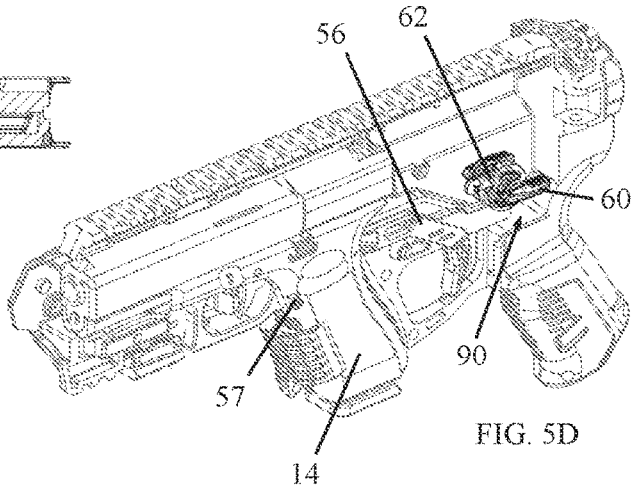
FIG. 5D is a simplified pictorial illustration of the ambidextrous safety selector installed on the conversion kit, showing the safety selector on the left side of the conversion kit, which can be rotated by the thumb of a right-handed shooter to either prevent or permit pulling the trigger member of the conversion kit that pulls the trigger of the handgun being held in the conversion kit.

Reference is now made to FIGS. 2A, 2B, and 2C, which illustrate a pistol-to-rifle conversion kit 72, in accordance with a non-limiting embodiment of the present invention. The present invention provides additional novel accessories for the prior art pistol-to-rifle conversion kit (whose reference numerals are maintained in the drawings of the invention) to create the novel pistol-to-rifle conversion kit 72. The accessories include one or more of the following in any combination thereof: an ambidextrous rifle body quick-lock fastener 74 (described with reference to FIG. 3), an ambidextrous magazine release button 80 (described with reference to FIGS. 4A-4D), an ambidextrous safety selector 90 (described with reference to FIGS. 5A-5D), and an assault-rifle-style charging handle 94 (described with reference to FIGS. 6A-6B).

Reference is now made to FIG. 3. It is seen that pistol-to-rifle conversion kit 72 may include a buttstock 42 that couples with rear buttstock mounting portion 38 by means of one or more fasteners 43.

The prior art pistol-to-rifle conversion kit used three clasps 69 to secure the halves 26R and 26L to each other. In contrast, the novel kit 72 replaces some or all of these clasps with a rifle body quick-lock fastener 74, which may include a quick-release bicycle-type fastener that includes a cam lever 75, a rod 76 (with a threaded end), a pivot pin 77, and a nut plate 78. The male-threaded end of rod 76 mates with the female-threaded nut plate 78 as cam lever 75 is rotated. Cam lever 75 is then pivoted around pivot pin 77 to provide the final tightening force. Cam lever 75 is accessible via apertures 73 formed in rifle-body halves 26R and 26L. When tightened, cam lever 75 may sit in aperture 73, either on the left side half or the right side half. The rifle body quick-lock fastener 74 is ambidextrous—it can be mounted for operation either from the left or the right side of the pistol-to-rifle conversion kit 72.

Although pistol-to-rifle conversion kit 72 may still employ a front clasp 69, the use of rifle body quick-lock fastener 74 enables the novel kit 72 to replace the prior art clasps on the top and bottom with mounting rail members 71. This advantageously provides a continuous mounting rail for mounting accessories.

Reference is now made to FIGS. 4A-4D, which illustrate ambidextrous magazine release button 80. The pistol 14 has its own magazine release button 57 (seen best in FIG. 5D and FIG. 6B, but also partially seen in FIG. 4D). The ambidextrous magazine release button 80 of the novel kit 72 allows actuating the magazine release button 57 from either the left or right side of the kit 72, no matter whether the magazine release button 57 is positioned for pressing on the left or right side of the pistol 14. Thus, the novel ambidextrous magazine release button 80 allows any shooter, left or right handed, to release the magazine without having to rework the pistol 14 to change the position of the magazine release button 57 from the position for a right-handed shooter to the position for a left-handed shooter or vice versa.

The ambidextrous magazine release button 80 may include a lever 82 that has a pushable portion 83 and a release-button pressing portion 84. The ambidextrous magazine release button 80 may further include a release-button rod 85 which is arranged to press against pushable portion 83. The release-button rod 85 may be spring-loaded by a biasing device 86 (such as a coil spring), held in place by a circlips 87. Lever 82 may pivot about a pivot pin 88, shown in FIG. 3.

The user can actuate the magazine release button 57 of pistol 14 by either pressing release-button rod 85 from the right side of the kit 72, which pushes pushable portion 83 outwards (pivoting about pin 88) and causes release-button pressing portion 84 to move inwards (pivoting about pin 88) and press against magazine release button 57 of pistol 14. Alternatively, magazine release button 57 of pistol 14 can be pressed by simply pressing on release-button pressing portion 84 on the left side of kit 72.

Reference is now made to FIGS. 5A-5D, which illustrate ambidextrous safety selector 90 of the conversion kit 72, in accordance with a non-limiting embodiment of the present invention.

The prior art pistol-to-rifle conversion kit, as seen in FIG. 1A, had only one trigger safety 60 on the left side of the kit, coupled to a cam 62, such as by a circlips 64. The ambidextrous safety selector 90 of the conversion kit 72 improves upon this by adding an additional trigger safety 92 coupled to a cam 91, such as by another circlips 64. The cam 62 of trigger safety 60 is coupled to trigger member 56. The additional trigger safety 92 is coupled to trigger safety 60, which means it is also coupled to trigger member 56. Rotation of the trigger safety 60 or the additional trigger safety 92 either prevents or permits pulling the trigger member 56. In one embodiment, the cam 91 of the additional trigger safety 92 is not coupled to trigger member 56 but its camming action provides positive stops for the additional trigger safety 92 to be either in the position for preventing or for permitting pulling the trigger member 56. Alternatively, cam 91 of the additional trigger safety 92 could be coupled to trigger member 56.

Figure 6A:
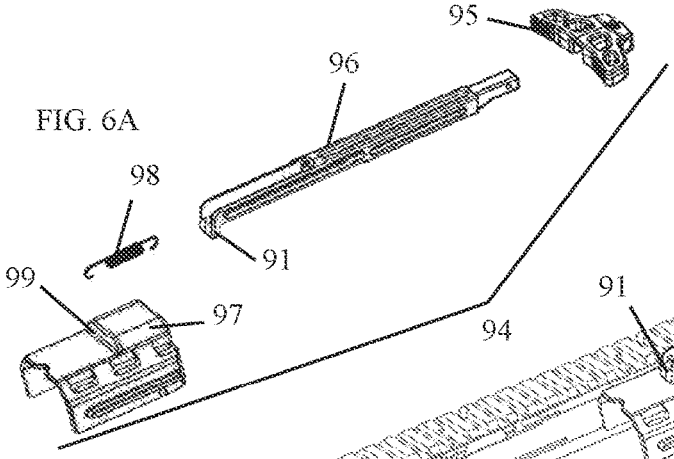
FIG. 6A is a simplified pictorial illustration of parts of an assault-rifle-style charging handle of the conversion kit, in accordance with a non-limiting embodiment of the present invention.
Figure 6B:
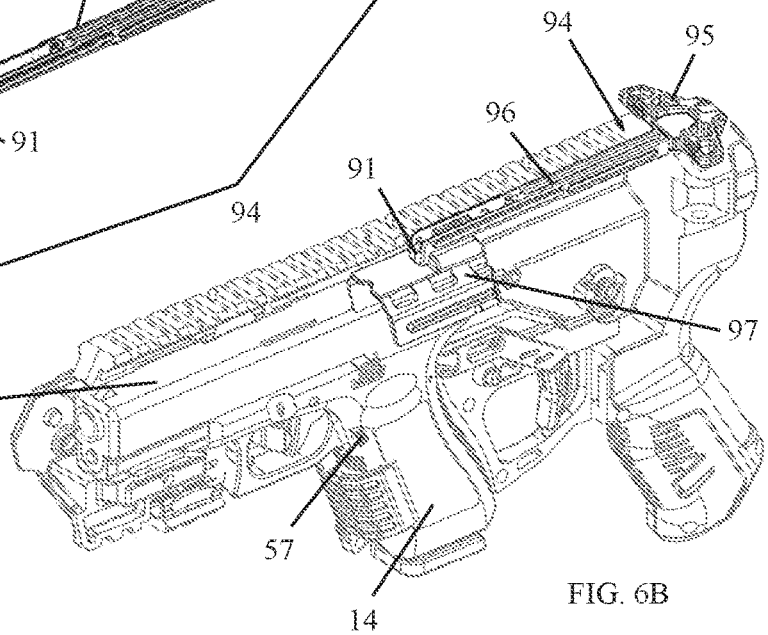
FIG. 6B is a simplified pictorial illustration of the assault-rifle-style charging handle installed on the conversion kit.

Reference is now made to FIGS. 6A-6B, which illustrate assault-rifle-style charging handle 94 of the conversion kit 72, in accordance with a non-limiting embodiment of the present invention. This replaces the charging handle 10 of the prior art.

Charging handle 94 may include a pull handle 95 coupled to a link member 96 which has a downward lip 91 (downward in the sense of the drawings) at a forward end thereof. The link member 96 may be spring-loaded by a biasing member 98, such as a coil spring. The lip 91 engages a slide engagement member 97, which as seen in FIG. 3, is coupled to the slide 12 of pistol 14, and may sit over a rear sight 17 of the pistol 14. The lip 91 may engage (abut against) a catch 99 (FIG. 6A) of slide engagement member 97. By pulling pull handle 95 of charging handle 94 rearwards, the slide engagement member 97 causes the slide 12 to move rearwards, so that slide 12 is racked and pistol 14 is charged.

The invention claimed is:

1. A pistol-to-rifle conversion kit comprising:

a rifle body that comprises a lower receiver, which includes a grip mounting portion, which is rearwardly adjacent to a trigger guard, which is rearwardly adjacent to a magazine well receiving portion, said rifle body being straight and non-pivoting from a rear buttstock mounting portion to a forward projectile exiting portion;

an auxiliary trigger sliding mounted in said rifle body and comprising an elongate member and a forward trigger interface member, which extends from a forward portion of said elongate member and which is configured to interface with a trigger of a pistol mounted in said rifle body, and a trigger member which extends from said elongate member for directly contacting a shooter's finger;

a charging handle wherein said charging handle comprises a pull handle configured to engage a slide of the pistol mounted in said rifle body and wherein said pull handle is configured to engage a slide of the pistol mounted in said rifle body and wherein said pull handle is coupled to a link member, which is spring-loaded by a biasing member; and one or more of the following in any combination thereof: an ambidextrous rifle body quick-lock fastener, an ambidextrous magazine release button, an ambidextrous safety selector.

2. The pistol-to-rifle conversion kit according to claim 1, wherein said ambidextrous rifle body quick-lock fastener comprises a quick-release bicycle-type fastener that includes a cam lever, a rod, a pivot pin, and a nut plate, wherein said rod threadingly mates with said nut plate.

3. The pistol-to-rifle conversion kit according to claim 1, wherein said ambidextrous magazine release button is arranged with respect to a pistol mounted in said rifle body, so that said ambidextrous magazine release button is arranged to actuate a magazine release button of the pistol, no matter whether the magazine release button of the pistol is positioned for pressing on a left or a right side of the pistol.

4. The pistol-to-rifle conversion kit according to claim 3, wherein said ambidextrous magazine release button comprises a lever, said lever comprising a pushable portion and a release-button pressing portion, and a release-button rod which is arranged to press against said pushable portion, said release-button rod being spring-loaded by a biasing device, and said lever being pivotable about a pivot.

5. The pistol-to-rifle conversion kit according to claim 1, wherein said ambidextrous safety selector comprises a first trigger safety on a first side of the kit and a second trigger safety on a second side of the kit opposite to the first side, wherein movement of either one of the first and second trigger safeties either prevents or permits pulling said trigger member.

* * * * *